US005916044A

United States Patent [19]

Shimosaka et al.

[11] Patent Number: 5,916,044

[45] Date of Patent: Jun. 29, 1999

[54] GOLF BALL

[75] Inventors: Hirotaka Shimosaka; Keisuke Ihara; Kazuto Maehara; Michio Inoue; Atsuki Kasashima, all of Chichibu, Japan

[73] Assignee: Bridgestone Sports Co., Ltd., Tokyo, Japan

[21] Appl. No.: 08/966,870

[22] Filed: Nov. 10, 1997

[30] Foreign Application Priority Data

Nov. 18, 1996 [JP] Japan ..... 8-322340

[51] Int. Cl.[6] ..... A63B 37/14

[52] U.S. Cl. ..... 473/384; 473/377

[58] Field of Search ..... 473/383, 384, 473/377

[56] References Cited

FOREIGN PATENT DOCUMENTS 27583 11/1912 United Kingdom ..... 273/232

2216016 10/1989 United Kingdom ..... 273/232

*Primary Examiner*—George J. Marlo

*Attorney, Agent, or Firm*—Sughrue, Mion, Zinn Macpeak & Seas, PLLC

[57] ABSTRACT

A golf ball defines a dimple spherical surface having a diameter of not greater than 42.66 mm and formed with a plurality of protrusions. The ball is unable to pass through a ring gage having an inner diameter of 42.67 mm.

15 Claims, 5 Drawing Sheets

GOLF BALL

BACKGROUND OF THE INVENTION

1. Field of the Invention

This invention relates to a golf ball having the advantages of a straight long-lasting trajectory, minimized windage, and added run like the small-size ball.

2. Prior Art

Golf is the game for players to compete using their skill fairly. Many rules have been prescribed in order to ensure the equality of play. Inter alia, strict specifications have been set forth for golf balls because individual players are allowed to select balls for play using their own responsibility.

With respect to golf balls, particularly authorized balls for professional tournaments, specifications on the weight, diameter, spherical symmetry, initial velocity and overall distance are set forth in the worldwide accepted Rules of Golf as approved by the United States Golf Association and the Royal and Ancient Golf Club of St. Andrews.

In the past, there were two rules regarding the diameter and weight of golf balls, that is, small-size balls and large-size balls. In 1920, the R&A set forth the rule of small-size ball specifying a weight of not greater than 1.62 ounces (45.93 g) and a diameter of not less than 1.62 inches (41.15 mm). In 1931, USGA set forth the rule of large-size ball specifying a weight of not greater than 1.62 ounces (45.93 g) and a diameter of not less than 1.68 inches (42.67 mm). The two rules were used for decades. In a harmonizing process, the R&A amended the rule in 1990 to change the ball diameter from "not less than 41.15 mm" (small-size ball) to "not less than 42.67 mm" (large-size ball). In Japan too, the use of large-size balls has been the rule in men's professional tournaments since 1977. Nowadays large-size balls are commonly used.

As compared with the small-size ball, the large-size ball has the advantages of afloat movement on the grass, easy approach shots and easy recovery shots from the rough, and promoted rolling upon putting. Inversely, the large-size ball has the disadvantages that when hit against the wind, the ball gains a higher trajectory and a greater fall angle, resulting in a reduced run and flight distance, and the path is readily curved.

There is a desire to have a golf ball which satisfies not only the specifications of the large-size ball, but also the requirements of a straight long-lasting trajectory, minimized windage, and added run like the small-size ball.

SUMMARY OF THE INVENTION

Therefore, an object of the present invention is to provide a golf ball which satisfies the specifications of the large-size ball and possesses good flight performance characteristic of the small-size ball.

According to the invention, there is provided a golf ball defining a spherical surface having a diameter of not greater than 42.66 mm and formed with a plurality of protrusions. The ball is unable to pass through a ring gage having an inner diameter of 42.67 mm. Preferably, the protrusions have a height of 0.01 to 1.0 mm from the spherical surface.

Most often, the spherical surface is further formed with a plurality of dimples.

With respect to the shape of protrusions, in preferred embodiments of the invention, some or all protrusions may have a hemi-spherical, round-crest conical or frusto-conical shape; some or all protrusions are annular protrusions each having a recess inside; some or all protrusions are annular protrusions each having a dimple inside; and/or some or all protrusions constitute a protruding strip extending along a great circle on the spherical surface.

The golf ball should preferably have axisymmetric surface topography.

Further preferably, the total of projection areas of the protrusions as projected on a plane accounts for 1 to 40% of the overall surface area of the original spherical surface. Also preferably, the total of projection areas of the recesses and the dimples as projected on a plane accounts for 10 to 85% of the overall surface area of the original spherical surface.

The present invention is successful in reducing the ball diameter in a substantial sense while satisfying the specifications of the large-size ball and in providing good flight performance characteristic of the small-size ball.

More particularly, although the diameter (not less than 42.67 mm) of the large-size ball is only 1.5 mm (about 3.7%) greater than the diameter (not less than 41.15 mm) of the small-size ball, the volume and surface area of the large-size ball are about 11.5% and about 7.5% greater than those of the small-size ball, respectively. Under the same shot conditions, the large-size ball receives greater lift and drag than the small-size ball because the lift and drag are proportional to the cross-sectional area, that is, the square of diameter. Also, the influence of dimples is closely related to the ball surface area and the influence of wind is closely related to the ball cross-sectional area. It is well known that by increasing the diameter of the small-size ball to the diameter of the large-size ball, flight performance is greatly affected beyond expectation. We have found that by forming protrusions on a spherical surface having a diameter of not greater than 42.66 mm, that is, by forming protrusions on a spherical surface having a diameter smaller than the diameter (≧42.67 mm) of the large-size ball and approximately equal to or smaller than the diameter of the small-size ball to define an enveloping circle having a diameter of not less than 42.67 mm, there is obtained a golf ball which cannot pass through a ring gage having an inner diameter of 42.67 mm, that is, which satisfies the diameter specification of the large-sizes ball. Like the small-size ball, the resultant ball follows a straight long-lasting trajectory, is resistant to windage, travels an added run distance, leading to an outstandingly increased flight distance.

BRIEF DESCRIPTION OF THE DRAWINGS

These and other objects, features and advantages of the invention will be better understood by reading the following description taken in conjunction with the accompanying drawings.

FIG. 1 illustrates protrusions on a golf ball according to one embodiment of the invention.

FIG. 2 illustrates protrusions on a golf ball according to another embodiment of the invention.

FIG. 3 illustrates a protruding strip on a golf ball according to a further embodiment of the invention.

FIG. 4 illustrates a protrusion surrounding an inside dimple on a golf ball according to a still further embodiment of the invention.

FIG. 5 illustrates a protrusion surrounded by an outside dimple on a golf ball according to a still further embodiment of the invention.

DESCRIPTION OF THE PREFERRED EMBODIMENTS

Figure 1A:
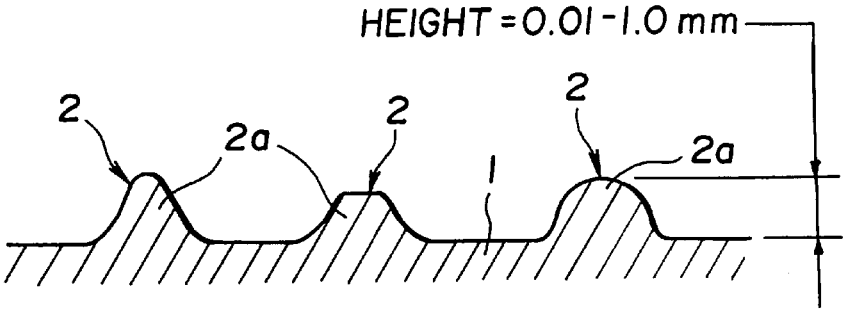
FIG. 1A is a cross-sectional view and FIG. 1B is a plane view.

It is noted that the cross-sectional views are given when the ball is cut radially with respect to the center of the ball and that when height or depth is referred to, it is a radial height or depth.

Referring to FIGS. 1 to 5, there are illustrated golf balls having protrusions according to different embodiments of the invention. The golf ball of the invention is originally a sphere 1 defining a spherical surface having a diameter of not greater than 42.66 mm, preferably 36 to 42.66 mm, more preferably 40 to 42.5 mm, most preferably 41 to 42.4 mm. The spherical surface is formed with a plurality of protrusions 2.

Figure 1B:
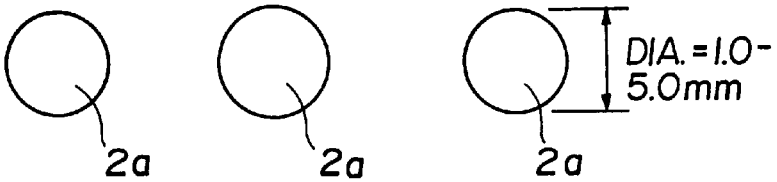
Figure 2A:
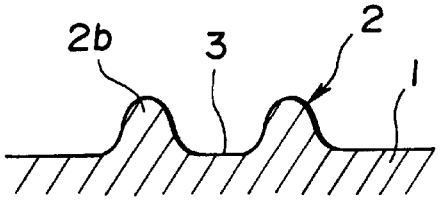
FIG. 2A is a cross-sectional view and FIG. 2B is a plane view.
Figure 2B:
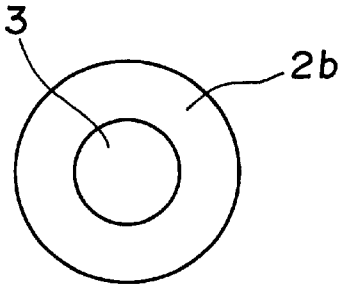
Figure 3A:
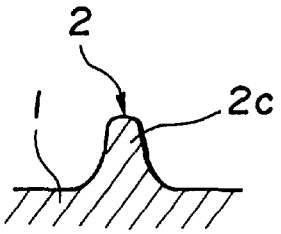
FIG. 3A is a cross-sectional view and FIG. 3B is a plane view.
Figure 3B:
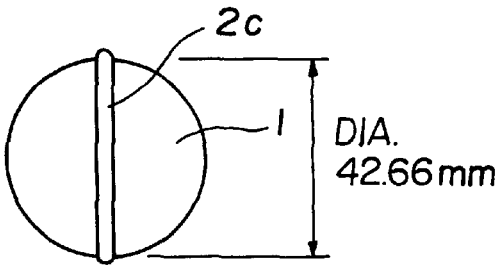
Figure 4A:
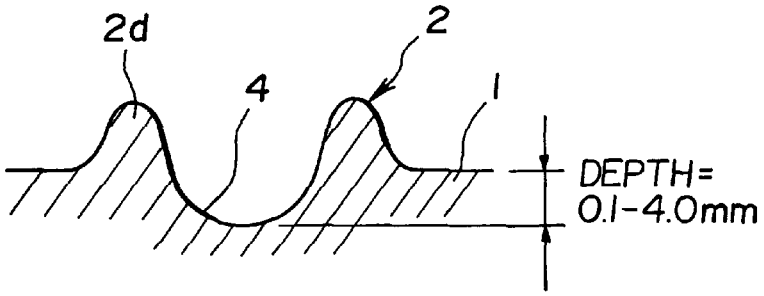
FIG. 4A is a cross-sectional view and FIG. 4B is a plane view.
Figure 4B:
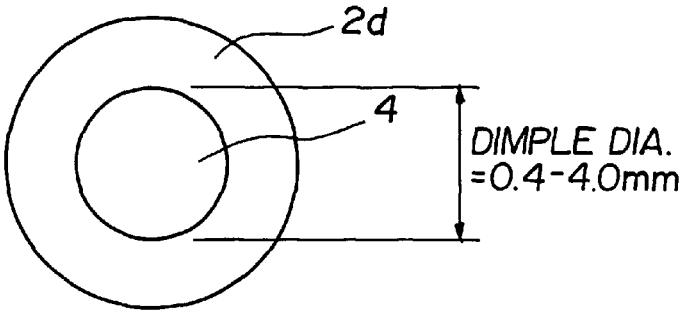
Figure 5A:
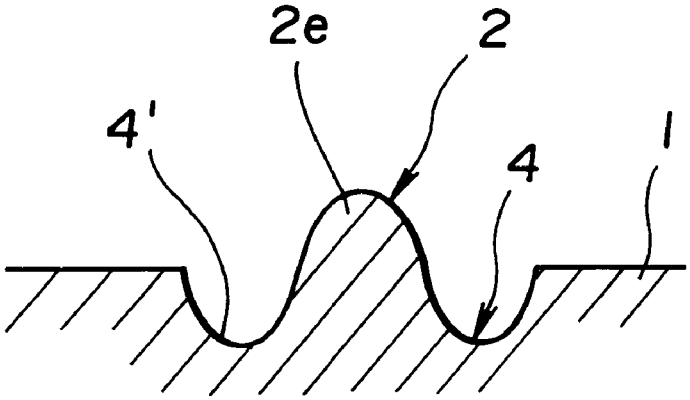
FIG. 5A is a cross-sectional view and FIG. 5B is a plane view.
Figure 5B:
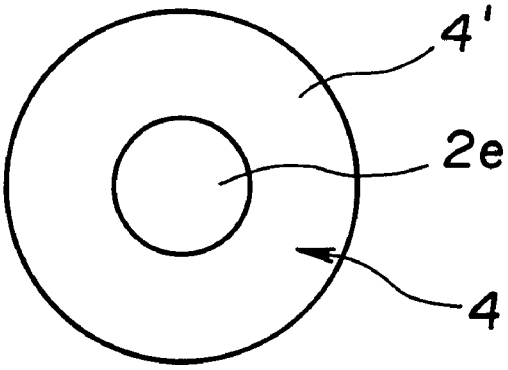

The shape of protrusions 2 is not critical. For example, the protrusion 2 has a hemi-spherical shape, a conical or pyramid (preferably conical) shape having a round top or a frusto-conical or frusto-pyramid (preferably frusto-conical) shape 2*a* as shown in FIGS. 1A and 1B. The protrusion 2 may be an annular protrusion 2*b* each surrounding a dimple-like recess 3 inside (like a somma) as shown in FIGS. 2A and 2B. The protrusions 2 may constitute a protruding circular strip 2*c* extending along a great circle on the sphere 1 as shown in FIGS. 3A and 3B. The protruding strip 2*c* is herein regarded as a continuous collection of protrusions. The protrusion 2 may also be an annular protrusion 2*d* each surrounding a dimple 4 inside as shown in FIGS. 4A and 4B. More specifically, the annular protrusion 2*d* circumscribes the edge of a dimple 4 which is formed in the surface of the sphere 1. Alternatively, as shown in FIGS. 5A and 5B, a dimple 4 is formed in the surface of the sphere 1 and a protrusion 2*e* is formed within the dimple 4 so that the crest of the protrusion projects beyond the surface. As a result of the formation of the protrusion 2*e*, the dimple 4 becomes an annular dimple 4'. There may be formed protrusions 2 having one of these shapes or a mixture thereof.

In the embodiment of FIG. 1, the hemi-spherical, conical or frusto-conical protrusions 2*a* are formed on land areas of the spherical surface when dimples 4 are formed in the spherical surface. In the embodiment of FIG. 2, the dimple-like recess 3 has a substantially flat bottom coincident with the spherical surface of the sphere 1. In 5 the embodiment of FIG. 3, the protruding strip 2*c* is not limited to one, and a plurality of, for example, 2 to 30, especially 2 to 15 protruding strips are preferably formed from the standpoint of symmetry. In the embodiment of FIG. 4, the dimple-surrounding annular protrusions 2*d* may be formed about all or some of the dimples.

In all the embodiments, the protrusions 2 preferably have a height of 0.01 to 1.0 mm, more preferably 0.1 to 0.8 mm, most preferably 0.2 to 0.7 mm from the spherical surface. In the embodiment of FIG. 5, the height of the protrusion is the height of the protrusion 2*e* extending beyond the surface of the sphere 1. In the embodiment of FIG. 1, the protrusion 2*a* preferably has a diameter of 1.0 to 5.0 mm, especially 3.0 to 4.2 mm. In the embodiments of FIGS. 2 and 4, the protrusions 2*b* and 2*d* preferably have a width of 0.5 to 2.2 mm, especially 0.8 to 1.5 mm. In the embodiment of FIG. 3, the strip 2*c* preferably has a width of 0.1 to 3.2 mm, especially 0.2 to 2.0 mm. In the embodiment of FIG. 2, the recess 3 preferably has a diameter of 0.4 to 3.6 mm, especially 0.8 to 2.6 mm.

On the golf ball of the invention, the dimples 4 are also formed. Preferably, the dimples are circular in plane shape and have a diameter of 0.4 to 4.0 mm, especially 1.6 to 3.6 mm and a depth of 0.01 to 0.4 mm, especially 0.05 to 0.2 mm. There may be formed dimples of two or more types which are different in diameter and/or depth. on the golf ball of the invention, the protrusions 2 are preferably formed in such a number that the total of projection areas of the protrusions as projected on a plane (see FIGS. 1B, 2B, 4B, and 5B) accounts for 1 to 40%, especially 4 to 28% of the overall surface area of the original spherical surface of the sphere 1. If the surface area occupation of protrusions is less than 1%, such a small number of protrusions would not exert their effect. If the surface area occupation of protrusions exceeds 40%, the ball would follow a trajectory approximate to the large-size ball. and be susceptible to windage.

Also preferably, the total of projection areas of the recesses 3 and the dimples 4 (inclusive of annular dimples 4') as projected on a plane (see FIGS. 2B, 4B, and 5B) accounts for 10 to 85%, especially 30 to 75% of the overall surface area of the original spherical surface. In this regard, the total of projection areas of the dimples 4 is preferably 10 to 85%, especially 30 to 75% of the total of projection areas of the recesses 3 and the dimples 4. The dimples 4 herein referred to are inclusive of those dimples which are not associated with protrusions.

Further preferably, the number of dimples is 80 to 560, especially 200 to 480. The total of the land areas of the sphere 1 where neither the dimples nor the protrusions are formed is preferably 3 to 50%, especially 10 to 35% of the overall surface area of the original spherical surface.

The golf ball of the invention should preferably have axisymmetric surface topography. The dimples 4 and dimple-like recesses 3 may be arranged in the same manner as prior art dimple arrangements. In this regard, the golf ball of the invention has the advantage that the great circle taken as a reference line in the prior art golf ball dimple arrangement design can be formed as a protruding strip 2*c*. The protruding strip 2*c* may be a full circle or segments extending exactly along or a little off the great circle.

While such protruding strips 2*c* are formed, the remaining land areas of the sphere may be additionally formed with hemi-spherical, conical or frusto-conical protrusions 2*a*.

With the above-mentioned construction, the golf ball of the invention fully satisfies the diameter specification of the large-size ball due to the formation of protrusions 2 although in a substantial sense, it has a diameter approximately equal to the small-size ball diameter. To definitely specify this feature, the present invention sets forth as an essential requirement that the ball is unable to pass through a ring gage having an inner diameter of 42.67 mm.

The ball "unable to pass through a ring gage having an inner diameter of 42.67 mm" means that the ball has a diameter complying with the Rules of Golf (the large-size ball). Exactly stated, the test involves resting the ball on a ring gage of stainless steel precisely worked to an inner diameter of 42.67 mm and turning around the ball on the gage which is held horizontal, thereby judging whether or not the ball passes through the gage under gravity. The test is randomly repeated 100 times for one ball. With a test result of less than 25 passes among 100 tests, the ball is regarded as "unable to pass through a ring gage having an inner diameter of 42.67mm." Since the golf ball is a rubber product whose diameter readily varies with temperature, the ball is kept at a constant temperature of 23±1° C. upon measurement.

The golf ball of the invention has a diameter satisfying the Rules of Golf (large-size ball) while it has; improved flight advantages including a straight long-lasting trajectory, windage resistance, and added run like the small-size ball.

With respect to the structure, the golf ball may be either a wound golf ball or a solid golf ball including a one-piece golf ball, two-piece golf ball, and multi-piece golf ball of a three or more layer structure. That is, the present invention is applicable to any type of golf ball. The ball may be prepared from well-known materials by conventional molding methods including injection molding and compression molding. The weight and other specifications of the ball may be properly selected in accordance with the Rules of Golf.

EXAMPLE

Examples of the invention are given below by way of illustration and not by way of limitation.

Examples 1–2

Two-piece golf balls were prepared by molding a composition comprising cis-1,4-polybutadiene as a base rubber and zinc acrylate as a crosslinking agent into a solid core having a diameter and a hardness (expressed by a distortion under a load of 100 kg) as shown in Table 1, and injection molding a cover stock based on an ionomer resin having a Shore D hardness of 56 around the solid core while forming protrusions and dimples on the surface of the cover.

Figure 6:
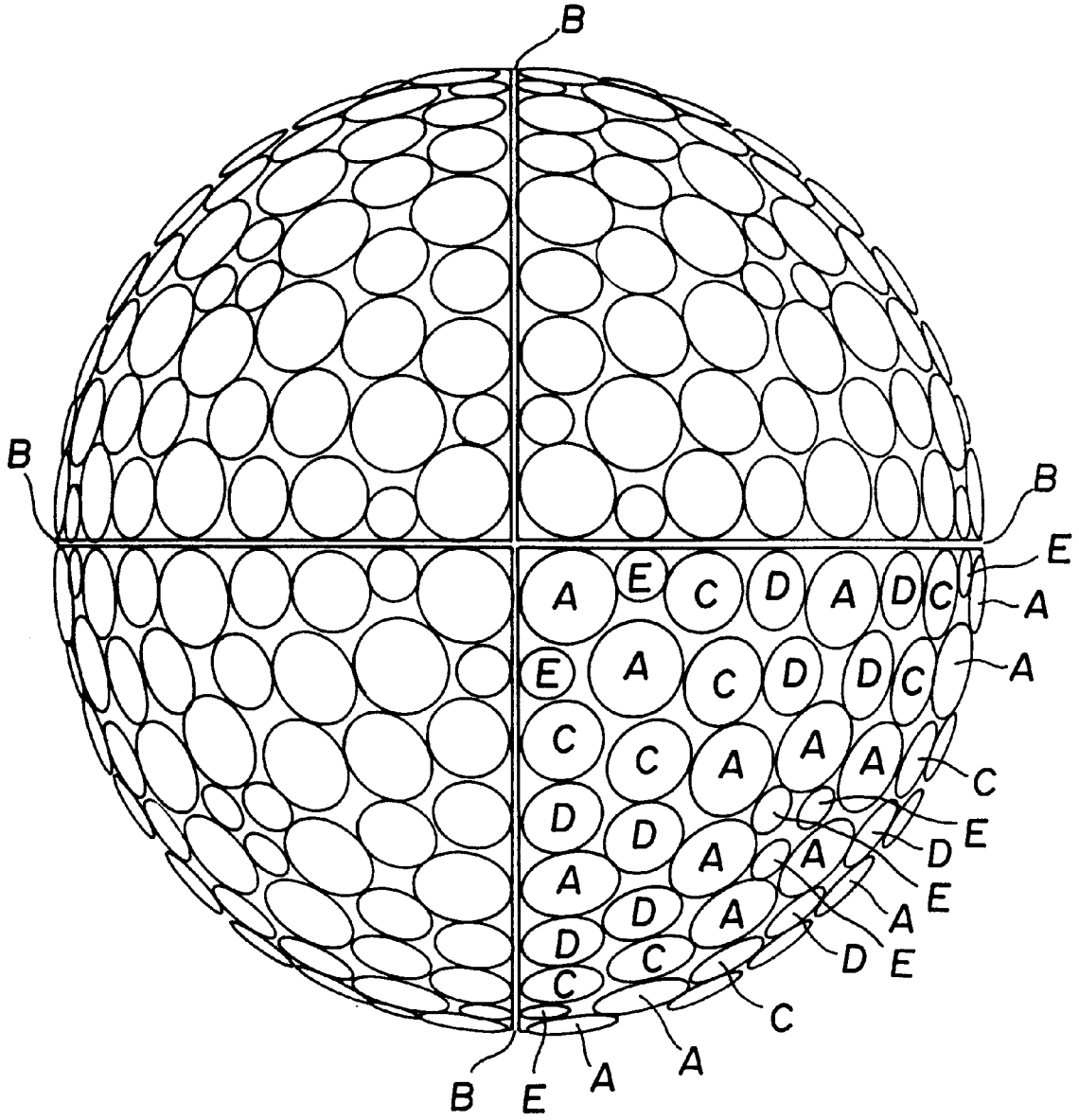
FIG. 6 illustrates a dimple arrangement pattern on a golf ball prepared in Examples 1 and 2 and Comparative Example.

The arrangement of dimples is illustrated in FIG. 6 wherein dimple areas in the fourth quadrant are designated A to E while such designation is omitted for dimples in the other quadrants due to the same arrangement.

Figure 7:
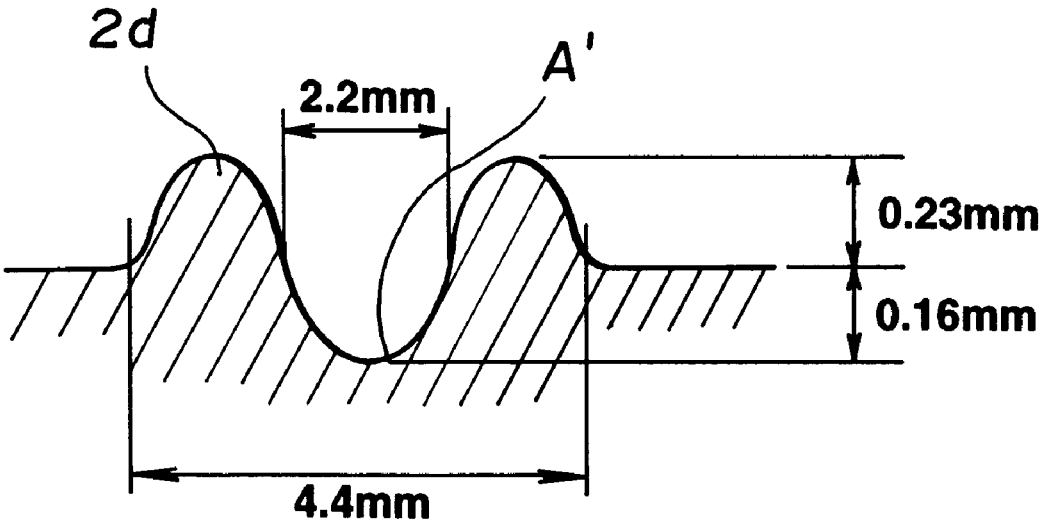
FIG. 7 is a cross-sectional view of a portion A of the ball of Example 1.

In the golf ball of Example 1, each area A was formed as a combination of a dimple A' having a diameter of 2.2 mm and a depth of 0.16 mm and an annular protrusion 2*d* having a width of 1.1 mm and a height of 0.23 mm surrounding the dimple A' along its outer peripheral edge as shown in FIG. 7. The annular protrusion 2*d* had an outer diameter of 4.4 mm and an inner diameter of 2.2 mm. No protrusions were formed at areas B. The remaining areas C, D and E were formed as dimples having a diameter and a depth as shown in Table 2. Although the original sphere had a diameter of 42.3 mm as shown in Table 1, the golf ball of Example 1 had a diameter of 42.76 mm (given as the distance of a line segment extending from the crest of one protrusion to the crest of an opposite protrusion through the ball center) because the protrusions in the form of annular protrusions 2*d* were formed on the spherical surface.

Figure 8:
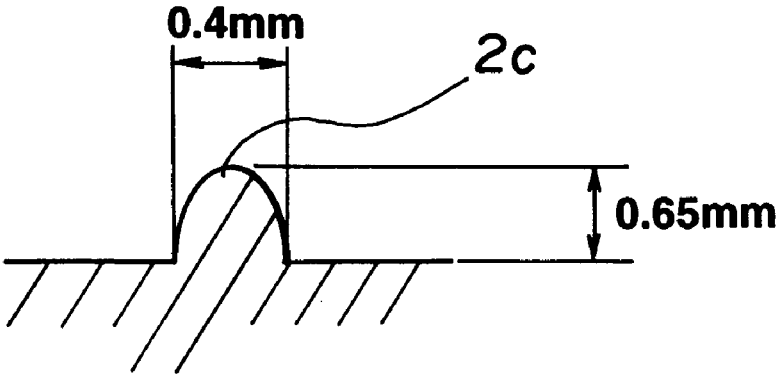
FIG. 8 is a cross-sectional view of a portion B of the ball of Example 2.

The golf ball of Example 2 was similar to Example 1 except that areas A were formed as dimples having a diameter of 4 mm and a depth of 0.15 mm and great circle areas B were formed as protruding strips 2*c* having a width of 0.4 mm and a height of 0.65 mm as shown in FIG. 8. Although the original sphere had a diameter of 41.5 mm, the golf ball of Example 2 had a diameter of 42.8 mm as a result of the formation of the protruding strips 2*c*.

For comparison purposes, a conventional large-size two-piece golf ball was prepared in Comparative Example 1. It had a ball diameter of 42.7 mm (equal to the original sphere diameter) and its dimple arrangement was the same as Example 2 except that dimples in areas A had a diameter of 4 mm and a depth of 0.18 mm and no protrusions were formed in great circle areas B.

TABLE 1

| | | E1 | E2 | CE1 |
|---|---|---|---|---|
| Solid core | Diameter (mm) | 38.3 | 37.5 | 38.7 |
| | Hardness (mm) | 3.6 | 3.5 | 3.6 |
| | Weight (g) | 35.3 | 35.0 | 35.4 |
| Cover | Gage* (mm) | 2.0 | 2.0 | 2.0 |
| | Hardness (Shore D) | 56 | 56 | 56 |
| Sphere diameter(mm) | | 42.3 | 41.5 | 42.7 |
| Ball diameter (mm) | | 42.76 | 42.8 | 42.7 |
| Ball weight (g) | | 45.4 | 45.2 | 45.4 |

*The cover gage in Examples 1 and 2 is the gage of the cover excluding protrusions.

TABLE 2

| | | E1 | E2 | CE1 |
|---|---|---|---|---|
| Area A (number 120): | Annular protrusion | FIG. 7 | — | — |
| | Width (mm) | 1.1 | — | — |
| | Height (mm) | 0.23 | — | — |
| | Dimple | | | |
| | Width (mm) | 2.2 | 4.0 | 4.0 |
| | Height (mm) | 0.16 | 0.15 | 0.18 |
| Area B (number 3): | Great circle | — | FIG. 8 | — |
| | Width (mm) | — | 0.4 | — |
| | Height (mm) | — | 0.65 | — |
| Area C (number 96): | Dimple | | | |
| | Diameter (mm) | 3.9 | 3.9 | 3.9 |
| | Depth (mm) | 0.16 | 0.16 | 0.16 |
| Area D (number 96): | Dimple | | | |
| | Diameter (mm) | 3.6 | 3.6 | 3.6 |
| | Depth (mm) | 0.15 | 0.15 | 0.15 |
| Area E (number 72): | Dimple | | | |
| | Diameter (mm) | 2.4 | 2.4 | 2.4 |
| | Depth (mm) | 0.11 | 0.11 | 0.11 |

The golf balls were examined for diameter by a gage test using a ring gage having an inner diameter of 42.67 mm. None of them could pass through the ring gage.

Using a swing robot (by Miyamae K. K.), the balls were hit with a driver at a head speed of 45 m/sec. to measure a carry and run. The results are shown in Table 3.

TABLE 3

| | Carry (m) | Run (m) |
|---|---|---|
| Example 1 | 213 | 13 |
| Example 2 | 211 | 16 |
| Comparative Example 1 | 212 | 10 |

It is evident from Table 3 that the golf balls within the scope of the invention gain an added run and hence, an increased flight distance since the ball diameter is reduced in a substantial sense.

There has been described a golf ball which has a diameter satisfying the specification of the large-size ball and the advantages of a straight long-lasting trajectory and added run like the small-size ball.

Application No. 322340/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising: a spherical surface having a diameter of not greater than 42.66 mm, a plurality of protrusions and a plurality of dimples, said protrusions having a height of 0.01 to 1.0 mm from the spherical surface and the total of projection areas of the protrusions as projected on a plane accounting for 1 to 400% of the overall surface area of the original spherical surface, and said golf ball being unable to pass through a ring gage having an inner diameter of 42.67 mm due to said protrusions formed on the spherical surface of the golf ball.

2. The golf ball of claim 1 wherein at least some of the protrusions have a hemi-spherical, round-crest conical or frusto-conical shape.

3. The golf ball of claim 1 wherein at least some of the protrusions are annular protrusions each having a recess inside.

4. The golf ball of claim 3, wherein said annular projections have a width of 0.5 to 2.2 mm.

5. The golf ball of claim 1 wherein at least some of the protrusions constitute a protruding strip extending along a great circle on the spherical surface.

6. The golf ball of claim 5, wherein said protrusions forming the protruding strip have a width of 0.1 to 3.2 mm.

7. The golf ball of claim 1 wherein at least some of the protrusions are annular protrusions each having a dimple inside.

8. The golf ball of claim 7, wherein some of the dimples are surrounded by the annular projections.

9. The golfball of claim 7, wherein all of the dimples are surrounded by the annular projections.

10. The golfball of claim 7, wherein said annular projections have a width of 0.5 to 2.2. mm.

11. The golf ball of claim 1 having axisymmetric surface topography.

12. The golf ball of claim 1 wherein at least some of the protrusions are annular protrusions each having a recess inside, the spherical surface is formed with a plurality of dimples, and the total of projection areas of the recesses and the dimples as projected on a plane accounts for 10 to 85% of the overall surface area of the original spherical surface.

13. The golf ball of claim 1, wherein said dimples have a diameter of 0.4 to 4.0 mm and a depth of 0.01 to 0.4 mm.

14. The golf ball of claim 1, wherein the number of dimples is 80 to 560.

15. The golf ball of claim 1, wherein the total of the land areas of the sphere where neither the dimples nor the protrusions are formed is 3 to 50% of the overall surface area of the original spherical surface.

* * * * *